US010274148B2

(12) United States Patent
Eidsvold et al.

(10) Patent No.: US 10,274,148 B2
(45) Date of Patent: Apr. 30, 2019

(54) ADJUSTMENT ASSEMBLY FOR A LIGHTING DEVICE

(71) Applicant: Intense Lighting, LLC, Anaheim, CA (US)

(72) Inventors: Kevin Brian Eidsvold, Yorba Linda, CA (US); Aida Spremo, Fountain Valley, CA (US); Jonathan Spicer, Lakewood, CA (US)

(73) Assignee: Leviton Manufacturing Co., Inc., Melville, NY (US)

( * ) Notice: Subject to any disclaimer, the term of this patent is extended or adjusted under 35 U.S.C. 154(b) by 344 days.

(21) Appl. No.: 15/383,464

(22) Filed: Dec. 19, 2016

(65) Prior Publication Data

US 2017/0307189 A1 Oct. 26, 2017

Related U.S. Application Data

(60) Provisional application No. 62/326,110, filed on Apr. 22, 2016.

(51) Int. Cl.

| | |
|---|---|
| ***F21K 9/20*** | (2016.01) |
| ***F21S 8/02*** | (2006.01) |
| ***F21V 21/04*** | (2006.01) |
| ***F21V 21/14*** | (2006.01) |
| ***F21Y 115/10*** | (2016.01) |

(52) U.S. Cl.

CPC ..... *F21S 8/026* (2013.01); *F21V 21/048* (2013.01); *F21V 21/14* (2013.01); *F21K 9/20* (2016.08); *F21Y 2115/10* (2016.08)

(58) Field of Classification Search

CPC ..... F21S 8/026; F21V 21/048; F21V 21/14
USPC ..... 362/235
See application file for complete search history.

(56) References Cited

U.S. PATENT DOCUMENTS

| | | | | |
|---|---|---|---|---|
| 3,518,420 A | | 6/1970 | Kripp et al. | |
| 4,048,491 A | * | 9/1977 | Wessman | F21V 21/04 248/343 |
| 5,077,650 A | * | 12/1991 | Cestari | F21V 21/04 362/147 |
| 5,907,648 A | * | 5/1999 | Miller | F21S 8/026 362/560 |

(Continued)

FOREIGN PATENT DOCUMENTS

WO 93/00552 A1 1/1993

*Primary Examiner* — Bryon T Gyllstrom

(57) ABSTRACT

A lighting fixture having an adjustable collar for accommodating different ceiling thicknesses is provided. The lighting fixture preferably includes a light module, a plaster frame, first and second support arms extending from the plaster frame, a U-shaped support assembly, an adjustment assembly for coupling the support assembly to the first and second support arms, and the collar. The adjustment assembly enabling the support assembly and the adjustable collar to be selectively movable along an axis perpendicular to the plaster frame. The adjustment assembly being configured so that, in a first configuration, the support assembly along with the light module and the collar are movable along the axis, and in a second configuration, the support assembly along with the light module and the collar are fixed to the first and second support arms so that a bottom end of the collar extends beyond a bottom surface of the plaster frame.

26 Claims, 8 Drawing Sheets

(56) References Cited

U.S. PATENT DOCUMENTS

| | | | | |
|---|---|---|---|---|
| 7,186,008 | B2 * | 3/2007 | Patti | F21S 8/02 362/147 |
| 7,234,674 | B2 * | 6/2007 | Rippel | F21V 21/04 248/343 |
| 7,896,529 | B2 * | 3/2011 | Wronski | F21S 8/02 362/365 |
| 7,967,480 | B2 | 6/2011 | Pickard et al. | |
| 8,182,120 | B1 | 5/2012 | Wronski et al. | |
| 8,636,387 | B1 | 1/2014 | Wronski et al. | |
| 2008/0112171 | A1 * | 5/2008 | Patti | F21S 8/02 362/365 |
| 2008/0224008 | A1 * | 9/2008 | Dal Ponte | E04B 9/006 248/298.1 |
| 2009/0080189 | A1 | 3/2009 | Wegner | |
| 2009/0284958 | A1 * | 11/2009 | Pickard | F21S 8/026 362/147 |
| 2011/0193498 | A1 * | 8/2011 | O'Boyle | F21S 8/02 315/362 |
| 2015/0241038 | A1 * | 8/2015 | Fryzek | F21V 21/047 362/147 |
| 2015/0252988 | A1 * | 9/2015 | Rashidi Doust | F21V 21/049 362/285 |
| 2016/0169490 | A1 * | 6/2016 | Kijima | F21V 21/15 362/235 |

* cited by examiner

ADJUSTMENT ASSEMBLY FOR A LIGHTING DEVICE

CROSS-REFERENCE TO RELATED APPLICATIONS

This application is a non-provisional of pending U.S. Provisional Patent Application Ser. No. 62/326,110, filed Apr. 22, 2016, titled "Adjustment Assembly for a Lighting Device," the entirety of which application is incorporated by reference herein.

FIELD OF THE DISCLOSURE

The present invention relates generally to a light fixture, and more particularly to a light fixture having a movable collar for accommodating a variety of different ceiling thicknesses while maintaining a consistent illumination level by maintaining the optic offset distance (maintaining a constant distance between a bottom surface of the ceiling and the lighting element).

BACKGROUND OF THE DISCLOSURE

Recessed lighting fixtures are often installed in ceiling structures to direct light down into a space. Such lighting fixtures can have the effect of making the associated space appear larger than it actually is. For example, recessed ceiling lighting fixtures can give the sense of a higher ceiling.

In ceiling applications, the fixtures and lighting elements are typically installed above the ceiling, and a reflector or other light-directing structure can extend through an opening in the ceiling to direct light down into the space. To provide a desired finish it is desirable that the reflector or other light-directing structure be installed flush with the ceiling surface. For new construction and retrofit applications, ceiling thicknesses can vary widely.

Adjustable lighting fixtures have been developed to accommodate different ceiling thicknesses found in older buildings and new architectural elements. For example, some adjustment mechanisms accommodate differing ceiling thicknesses by allowing the reflector or other light directing structure to be extended down into the ceiling opening while retaining the lighting element fixed with respect to the top surface of the ceiling. This enables the bottom edge of the reflector or other light directing structure to fit flush with the bottom surface of the ceiling. But changing the distance from the bottom of the ceiling surface to the front edge of the light element can have an adverse effect on the lighting levels from the fixtures. Thus, the finished lighting levels may differ from the levels that were assumed by the lighting designer. This is because lighting simulations, which are increasingly used by room designers, are based on light output models which assume the light to be a fixed distance from the bottom surface of the ceiling. Current adjustability arrangements, therefore, can have an undesirable impact on certain room lighting levels.

It would be desirable to provide a lighting fixture incorporating an adjustment assembly that accommodates a variety of different ceiling thicknesses while also maintaining a constant distance between the bottom surface of the ceiling and the front edge of the lighting element in order to provide final lighting levels in the room that are consistent with a designer's light output models. Such an adjustment assembly should be easy for a user to install and adjust.

SUMMARY OF THE DISCLOSURE

A lighting device is disclosed. The lighting device may include an adjustable collar for accommodating different ceiling thicknesses, a plaster frame having an opening for receiving the adjustable collar, at least one support arm coupled to the plaster frame adjacent the opening, a support assembly, and an adjustment assembly for coupling the at least one support arm to the support assembly to enable the support assembly and the adjustable collar to be selectively movable, wherein the adjustment assembly has a first configuration in which the adjustable collar is movable, and a second configuration in which the support assembly and the adjustable collar are fixed to the at least one support arm so that a bottom end of the adjustable collar extends beyond a bottom surface of the plaster frame. The at least one support arm may include first and second support arms coupled to the plaster frame adjacent the opening, the first and second support arms extending from the plaster frame. In the first configuration, the adjustable collar may be vertically movable towards and away from the plaster frame.

The support assembly may include first and second side portions and a top portion so that the support assembly forms a generally U-shape support assembly. The first and second side portions may be coupled to the adjustable collar. The first and second side portions may be positionable adjacent the first and second support arms, respectively, so that the adjustment assembly couples the first and second support arms to the first and second side portions of the support assembly. The first and second support arms may be coupled at respective first ends to the plaster frame adjacent the opening, and the first and second side portions of the support assembly are coupled at respective first ends to the adjustable collar.

In the second configuration, the support assembly and the adjustable collar may be fixed to the first and second support arms so that a bottom end of the adjustable collar extends beyond a bottom surface of the plaster frame by a predetermined distance. The support assembly may be fixed to the adjustable collar so that the support assembly and the adjustable collar are movable together along an axis with respect to the plaster frame.

The adjustment assembly may include an adjustment plate and a locking knob positioned on opposite sides of the first support arm and first side portion. In the first configuration, the locking knob and adjustment plate may be positioned with respect to each other to enable movement of the first side portion with respect to the first support arm along an axis. In the second configuration, the locking knob clamps the first support arm and the first side portion between the locking knob and the adjustment plate to lock the first support arm to the first side portion thus preventing relative motion therebetween along the axis.

The top portion of the support assembly may include surface features configured to couple the adjustment assembly to a removable light module such that the removable light module is movable along the axis simultaneously with the support assembly and the adjustable collar. The removable light module may include a heat sink, a plurality of LEDs and an optic.

The present disclosure is also discloses a method for adjusting a lighting device for accommodating different ceiling thicknesses. The method may include installing a lighting device in or on a ceiling structure, the lighting device including an adjustable collar, a plaster frame and a light module having a lighting element, positioning a portion of the adjustable collar of the lighting device through a first opening in the ceiling structure and a second opening in the plaster frame, and adjusting the position of the adjustable collar with respect to the plaster frame and the ceiling structure so that a distal end surface of the adjustable collar is positioned adjacent to a distal portion of the second opening in the ceiling structure. During the adjusting step, a front surface of the LED may remain a fixed distance from the distal end surface of the adjustable collar.

Positioning a portion of the adjustable collar of the lighting device through a first opening in the ceiling structure may include adjusting a position of a U-shaped support assembly with respect to the plaster frame. The U-shaped support assembly may be fixedly coupled to the light module and the adjustable collar.

The method may also include the step of securing the position of the adjustable collar with respect to the first opening in the ceiling structure and the second opening in the plaster frame. The securing step may include turning a locking knob to draw first and second support arms coupled to the plaster frame into engagement with first and second side portions of a U-shaped support assembly such that friction between the first and second support arms and the first and second side portions, respectively, prevents movement of the U-shaped support assembly and the adjustable collar with respect to the plaster frame.

The method may also include the step of provisionally retaining the adjustable collar and the light module in position with respect to the plaster frame and the ceiling structure via a plunger engaged with a U-shaped support assembly and first and second support arms. The first and second support arms may be coupled to the plaster frame, the light module may be coupled to the U-shaped support assembly, and the U-shaped support assembly may be moveably coupled to the first and second support arms.

An adjustment assembly for a lighting device is also disclosed. The adjustment assembly may include an adjustable collar for accommodating different ceiling thicknesses, a plaster frame having an opening for receiving the adjustable collar, first and second support arms coupled to the plaster frame, a support assembly having first and second side portions and a top portion, the first and second side portions coupled to the adjustable collar, an adjustment assembly coupled between at least one of (i) the first support arm and the first side portion and (ii) the second support arms and the second side portion to enable the support assembly and the adjustable collar to be selectively movable along an axis perpendicular to the plaster frame, and an adjustment plate and a locking knob positioned on opposite sides of the first support arm and the first side portion. The adjustment assembly may include a first configuration in which the adjustable collar portion is movable along the axis, and a second configuration in which the support assembly and the adjustable collar may be fixed to the first and second support arms so that a bottom end of the adjustable collar extends beyond a bottom surface of the plaster frame. In the first configuration, the locking knob and adjustment plate may be positioned with respect to each other to enable movement of the first side portion with respect to the first support arm along the axis. In the second configuration, the locking knob clamps the first support arm and the first side portion between the locking knob and the adjustment plate to lock the first support arm to the first side portion, thus preventing relative motion therebetween along the axis.

BRIEF DESCRIPTION OF THE DRAWINGS

By way of example, a specific embodiment of the disclosed device will now be described, with reference to the accompanying drawings, in which.

DETAILED DESCRIPTION

The following disclosure is intended to provide exemplary embodiments of the disclosed system and method, and these exemplary embodiments should not be interpreted as limiting. One of ordinary skill in the art will understand that the steps and methods disclosed may easily be reordered and manipulated into many configurations, provided they are not mutually exclusive. As used herein, "a" and "an" may refer to a single or plurality of items and should not be interpreted as exclusively singular unless explicitly stated.

Figure 1:
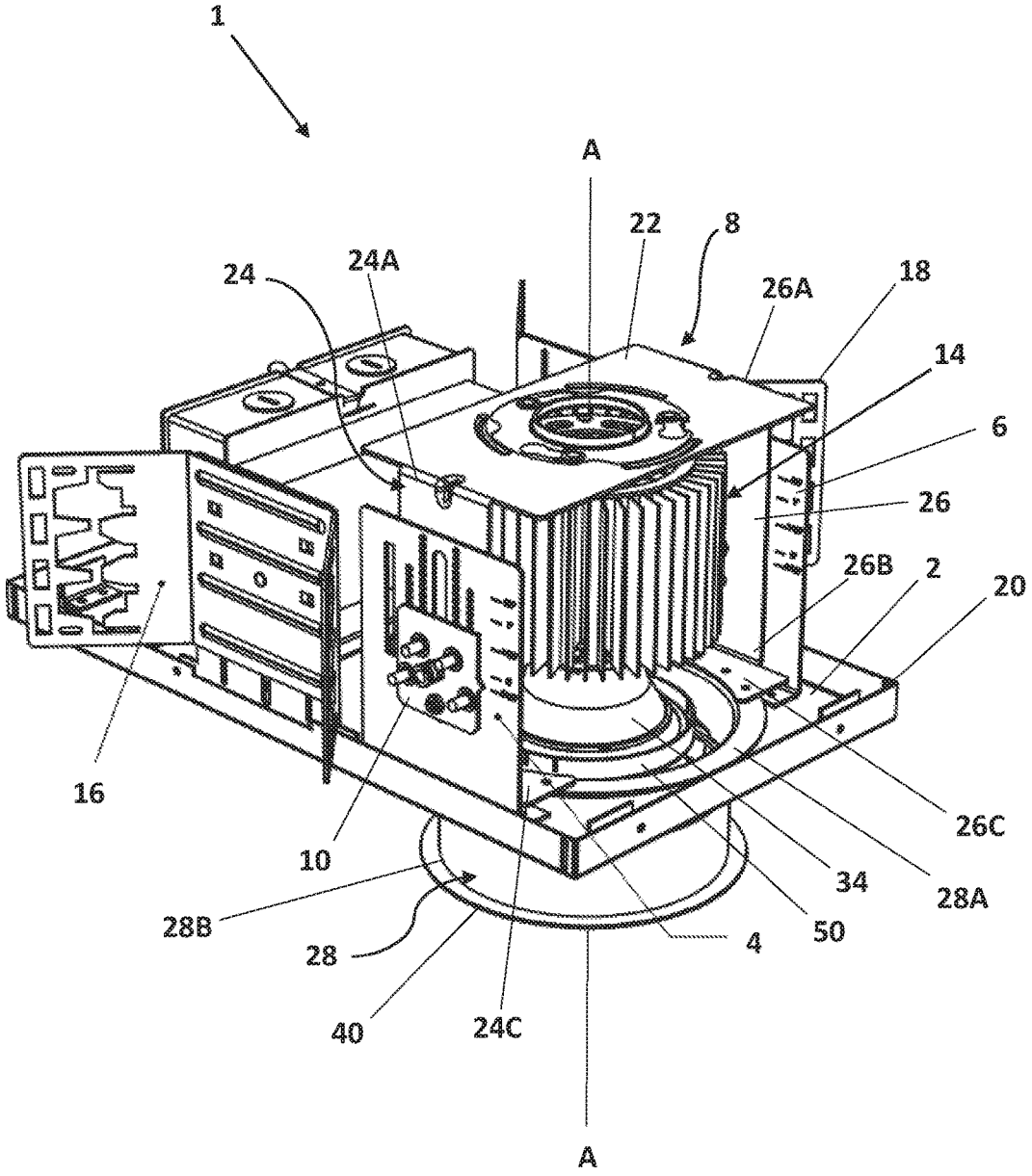
FIG. 1 is an isometric view of an exemplary adjustable lighting assembly according to the disclosure.
Figure 2:
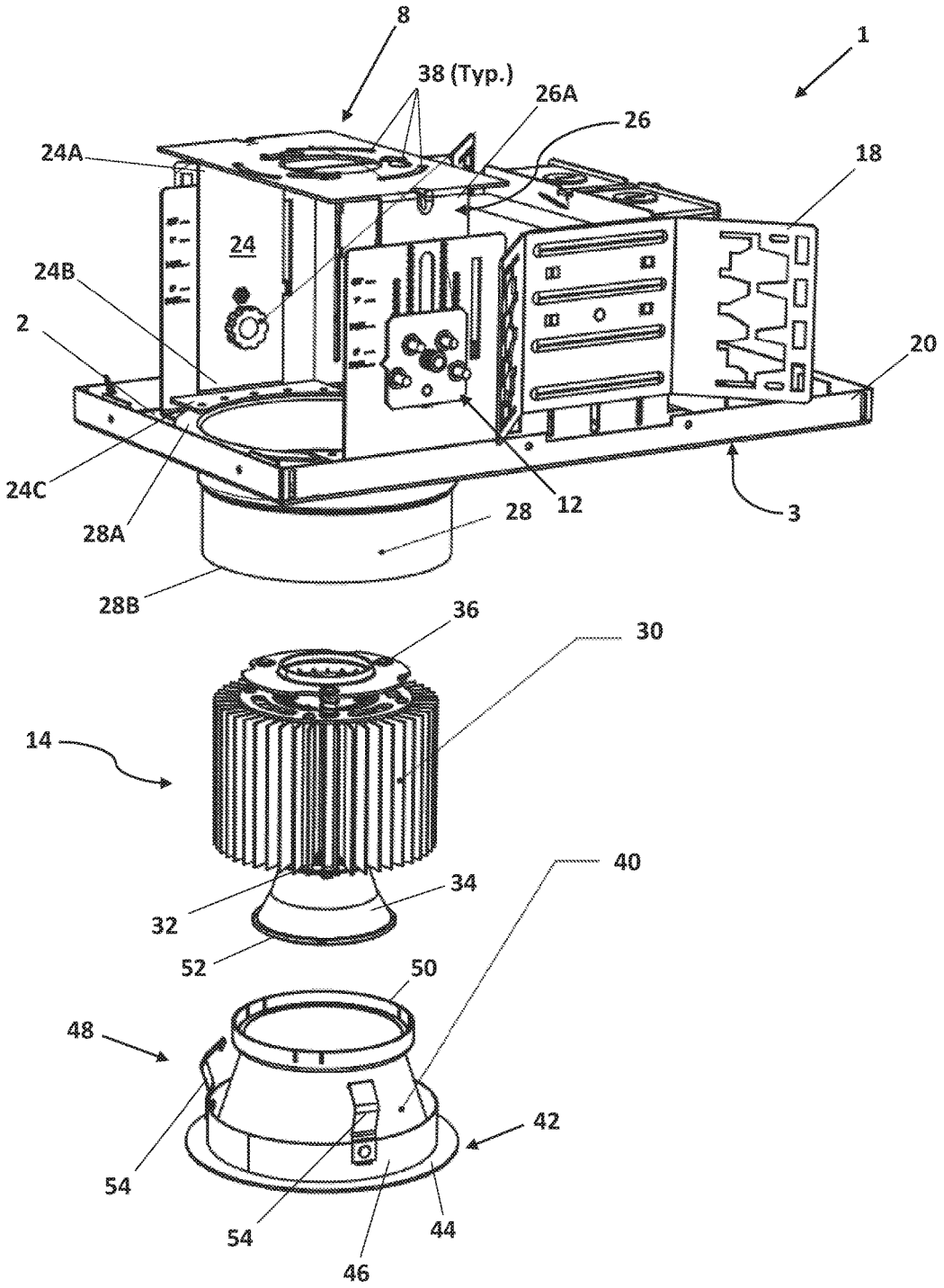
FIG. 2 is an exploded view of the exemplary adjustable lighting assembly of FIG. 1.

FIGS. 1 and 2 show an exemplary adjustable lighting assembly 1 according to the disclosure. The adjustable lighting assembly 1 may include a base plate or plaster frame 2, first and second support arms 4, 6 coupled to the plaster frame, a U-shaped support assembly 8, and first and second adjustment assemblies 10, 12 for coupling and securing the U-shaped support assembly 8 to the first and second support arms 4, 6. A removable light module 14 may be coupled to the U-shaped support assembly 8. As will be described in greater detail, the first and second adjustment assemblies 10, 12 may be used to adjust the position of the U-shaped support assembly 8 and the removable light module 14 along an adjustment axis A-A which may be oriented perpendicular to a plane defined by the plaster frame 2.

The plaster frame 2 may further include one or more hanger bar brackets 16, 18 for allowing the adjustable lighting assembly 1 to be fixed to one or more features of a ceiling structure such as C-channels, flat bar hangers and the like. In addition, the plaster frame 2 may include a vertical flange 20 disposed about the perimeter of the plaster frame 2, although this is not required.

The U-shaped support assembly 8 can include a top portion 22 and first and second side portions 24, 26 oriented perpendicular to the top portion 22. In the illustrated embodiment, the first and second side portions 24, 26 are coupled at respective proximal ends 24A, 26A to the top portion 22. The first and second side portions 24, 26 can extend downward toward the plaster frame 2 where they are respectively coupled at the distal ends 24B, 26B to an adjustable collar 28. In this way the adjustable collar 28 can be fixed to the U-shaped support assembly 8 in a manner that enables a portion of the adjustable collar 28 to extend through an opening (not shown) in the plaster frame 2. In the illustrated embodiment the distal ends 24B, 26B of the first and second side portions include flange portions 24C, 26C that couple to a proximal flange portion 28A of the adjustable collar 28 via a suitable coupling arrangement such as drawn stamping, fasteners, welding, adhesives or the like. As can be seen, the proximal flange portion 28A of the adjustable collar 28 can be positioned above the plaster frame 2 while a bottom end 28B of the adjustable collar 28 extends below a bottom surface 3 of the plaster frame 2.

As best shown in FIG. 2, the removable light module 14 can include a heat sink 30, a plurality of light emitting diodes (LEDs) 32 and an optic 34. As will be appreciated, the optic 34 can be in the form of a reflector, a diffusion lens, a Fresnel lens, or the like. A top end of the heat sink 30 may include a mounting plate 36 which, in the illustrated embodiment, is configured to enable the removable light module 14 to be removably coupled to surface features 38 provided in or on the top portion 22 of the U-shaped support assembly 8.

A trim portion 40 may be provided for coupling to the adjustable collar 28 to provide a finished appearance once the adjustable lighting assembly 1 has been installed. The trim portion 40 may include a first end 42 having a flange portion 44 and a collar portion 46 for engaging an opening in a ceiling. The trim portion 40 may also include a second end 48 having a collar portion 50 for surrounding, associating with trim accessories and/or engaging a front edge 52 of the optic 34. A plurality of spring clips 54 can be provided intermediate the first and second ends to allow the trim portion 40 to be removably coupled to the adjustable collar 28.

As will be appreciated, the disclosed arrangement ensures that the front edge 52 of the optic 34 and the bottom end 28B of the adjustable collar 28 (and trim portion 40) are maintained in the same fixed positional relationship (along the axis A-A) regardless of the thickness of the ceiling in which the adjustable lighting assembly 1 is installed. This ensures that the light output by the LEDs 32 and transmitted by the optic 34 is transmitted to the room in a manner consistent with simulated lighting models used to design the lighting layout for the room.

Figure 3:
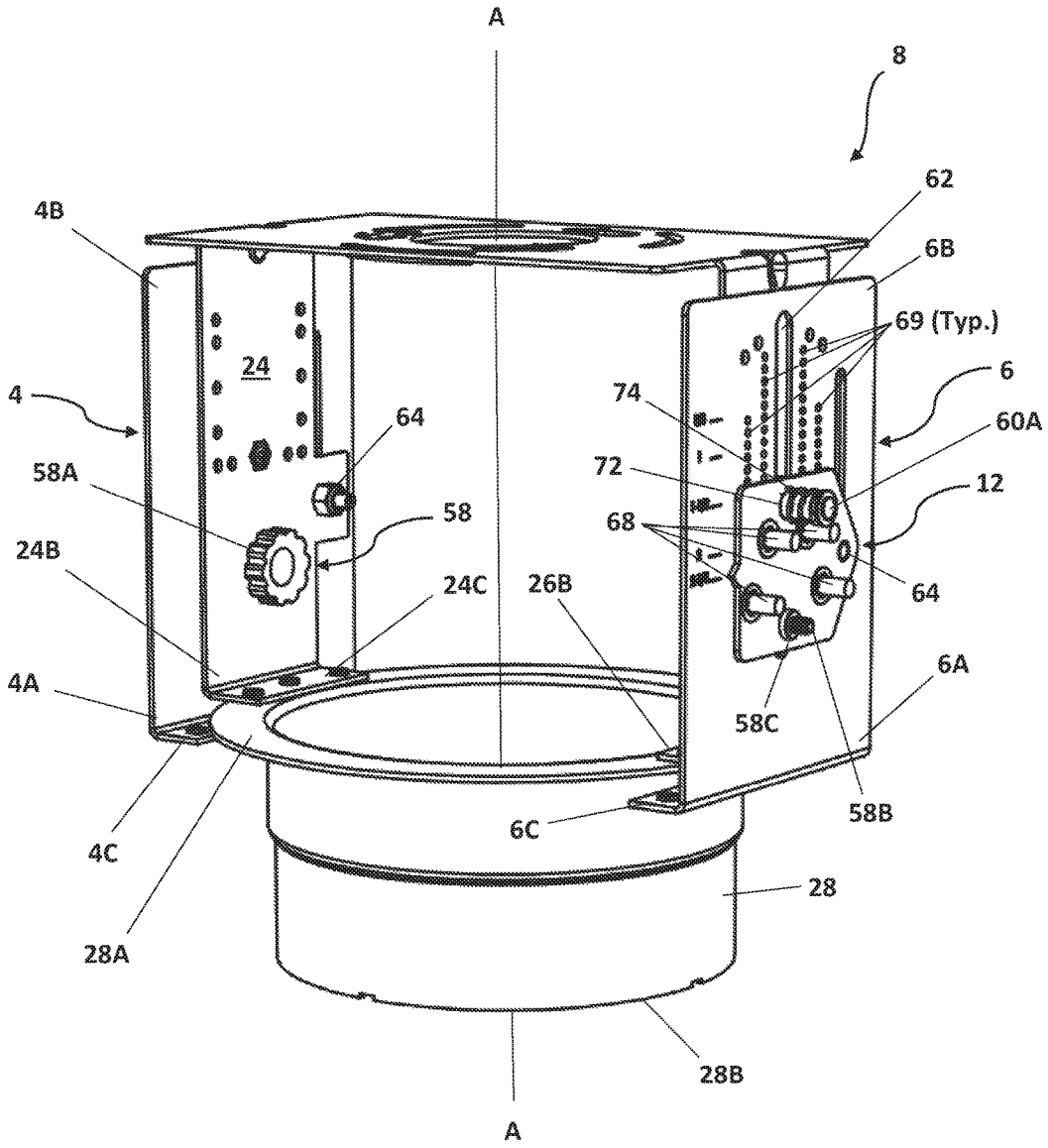
FIG. 3 is an isometric view of an exemplary adjustment assembly portion of the adjustable lighting assembly of FIG. 1.
Figure 4:
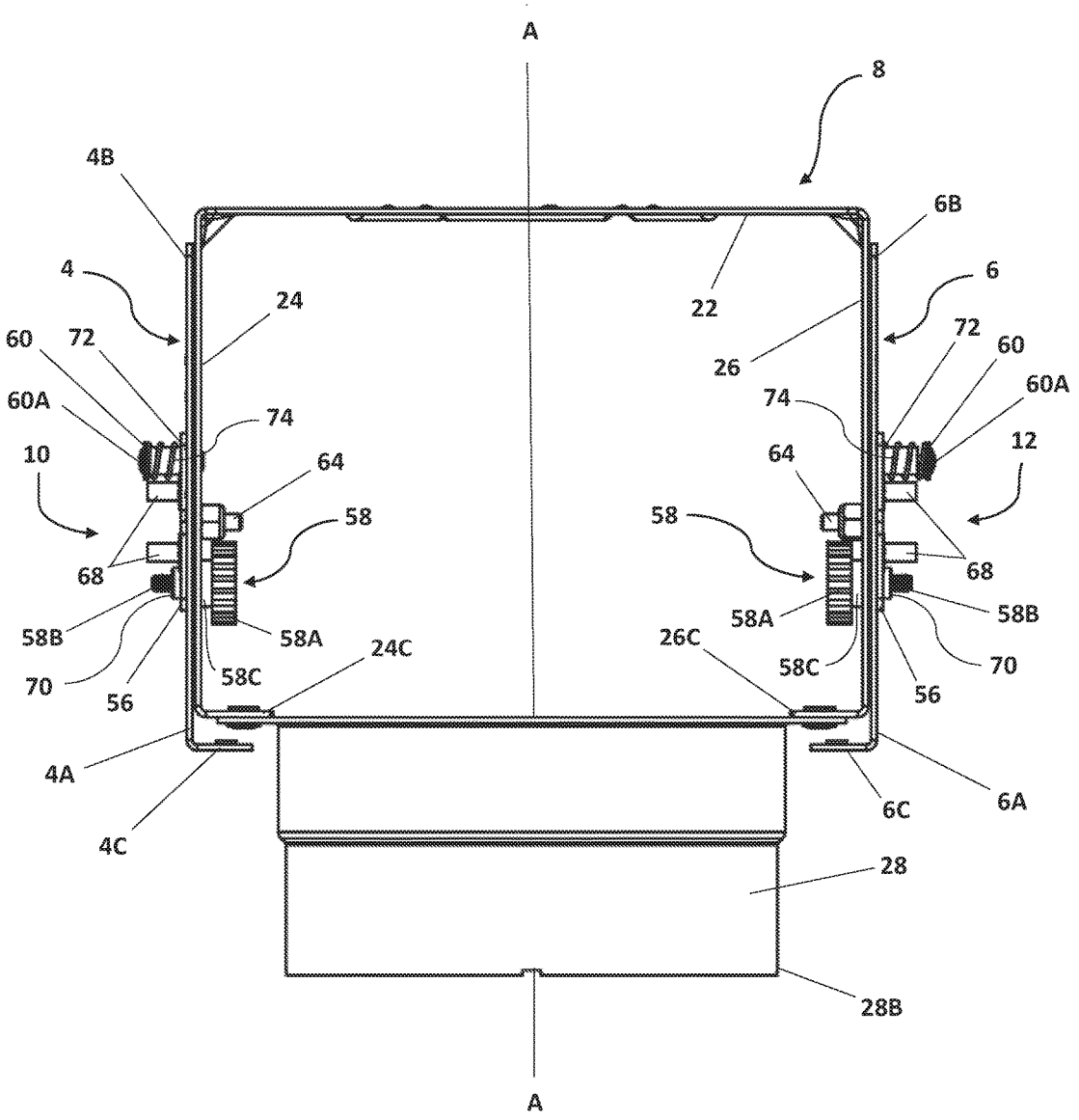
FIG. 4 is an end view of the adjustment assembly portion of FIG. 3.
Figure 5:
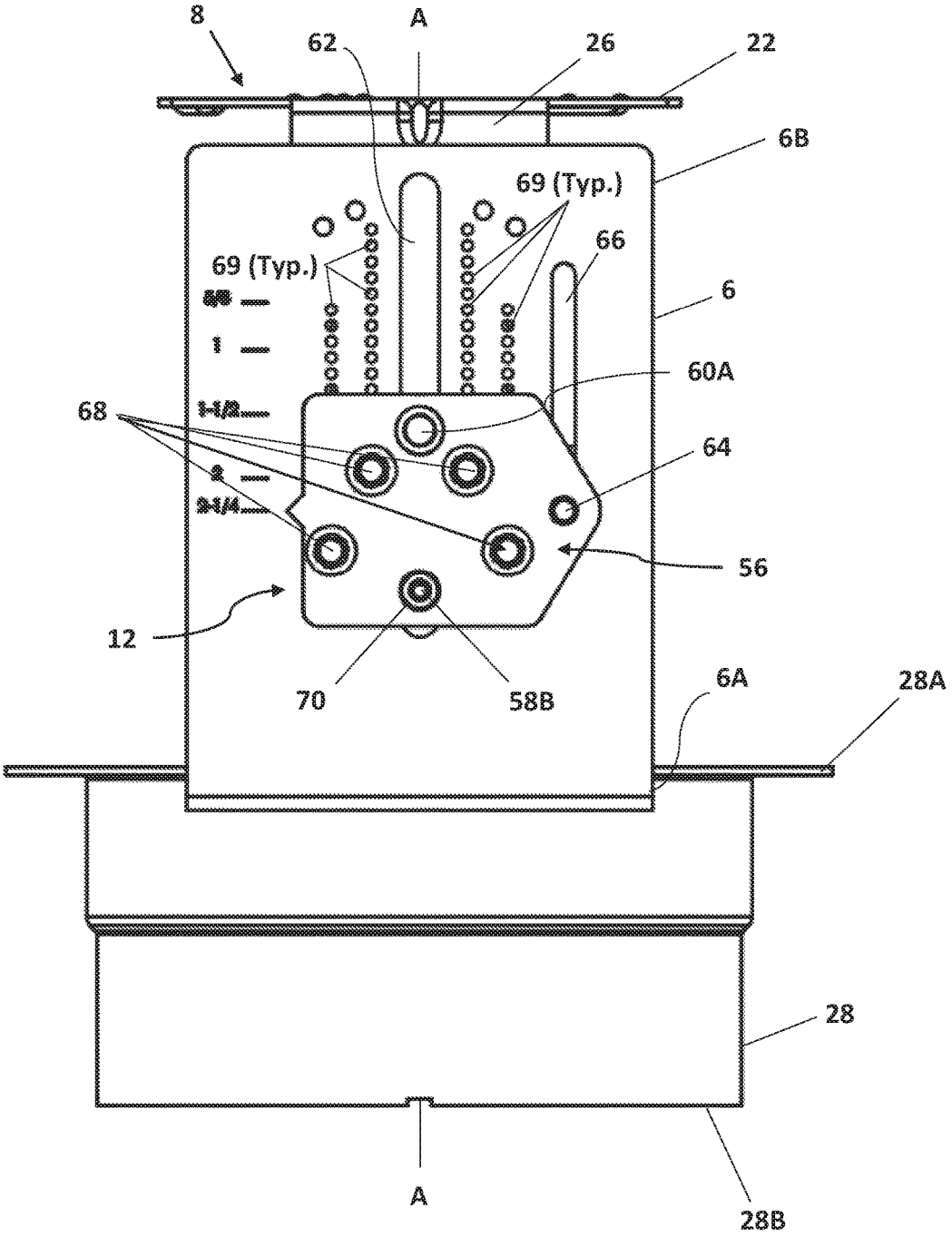
FIG. 5 is a side view of the adjustment assembly portion of FIG. 3.

Referring now to FIGS. 3-5, the inter-relationship between the U-shaped adjustment assembly 8 and the first and second support arms 4, 6 will be described in greater detail. As can be seen, the first and second support arms 4, 6 can be coupled at respective first ends 4A, 6A to the plaster frame 2 (see FIG. 1), and can have second ends 4B, 6B that extend up and away from the plaster frame 2 substantially perpendicularly to the plane of the plaster frame 2. In the illustrated embodiment, the first ends 4A, 6A of the first and second support arms 4, 6 include flange portions 4C, 6C that engage the plaster frame 2 via a suitable coupling arrangement such as fasteners, welding, adhesives or the like.

The first and second support arms 4, 6 may be arranged to lie adjacent to the first and second side portions 24, 26 of the U-shaped support assembly 8. In the illustrated embodiment, the first and second support arms 4, 6 are positioned slightly farther laterally apart than the first and second side portions 4, 6 so that the first and second side portions 24, 26 are received between the first and second support arms 4, 6.

As previously mentioned, the U-shaped support assembly 8 (along with the removable light module 14 and the adjustable collar 28 that are attached thereto) are preferably movable along adjustment axis A-A, which in the illustrated embodiment is oriented perpendicular to a plane defined by the plaster frame 2, with respect to the first and second support arms 4, 6. To secure the position of the U-shaped support assembly 8 (along with the position of the removable light module 14 and the adjustable collar 28 that are attached thereto) with respect to the first and second support arms 4, 6 at a desired position along the adjustment axis A-A, first and second adjustment assemblies 10, 12 may be included to couple the first and second support arms 4, 6 to the first and second side portions 24, 26, respectively. As will be discussed in greater detail, the first and second adjustment assemblies 10, 12 may each have a first configuration in which the U-shaped support assembly 8 and the adjustable collar 28 are movable along the adjustment axis A-A, and a second configuration in which the U-shaped support assembly 8 and the adjustable collar 28 are fixed to the first and second support arms 4, 6 so that a bottom end 28B of the adjustable collar 28 extends beyond the bottom surface 3 of the plaster frame 2.

While any mechanism now known or hereafter developed may be used to secure the position of the U-shaped support assembly 8 (along with the position of the removable light module 14 and the adjustable collar 28 that are attached thereto) with respect to the first and second support arms 4, 6, the first and second adjustment assemblies 10, 12 may each include an adjustment plate 56, a locking knob 58, a guide link 60 disposed in a guide slot 62 formed in the first and second support arms 4, 6, a second guide link 64 disposed in a second guide slot 66 in the first and second support arms 4, 6, and a plurality of plungers 68 that are selectively engageable with respective recesses or openings 69 disposed in a surface of the first and second support arms 4, 6 to form a detent mechanism.

The description will proceed in relation to the locking arrangement for the first adjustment assembly 10. It will be appreciated, however, that the description can apply equally to the locking arrangement associated with the second adjustment assembly 12. The locking knob 58 may have a grasping portion 58A positioned adjacent the first side portion 24 of the U-shaped support assembly 8, and a threaded shank portion 58B that is disposed through the guide slot 62 and is received in a threaded opening 70 in the adjustment plate 56. The locking knob 58 may also have a shoulder portion 58C disposed between the grasping portion 58A and the threaded shank portion 58B. The shoulder portion 58C may be larger than the threaded opening 70 so that it abuts a surface of the first side portions 24 of the U-shaped support assembly 8. Thus, when the locking knob 58 is rotated in a first direction, the threaded engagement between the locking knob 58 and the adjustment plate 56 may cause the adjustment plate 56 to be drawn toward the shoulder portion 58C of the locking knob 58. The adjustment plate 56 and shoulder portion 58C can thereby force the first support arm 4 into tight engagement with the first side portion 24 of the U-shaped support assembly 8, locking the U-shaped support assembly 8 in place with respect to the first and second support arms and the plaster frame 2. The U-shaped support assembly 8, along with the removable light module 14 and adjustable collar 28 can thereby be fixed in relation to the plaster frame 2 so that they cannot move along the adjustment axis A-A.

As will be readily appreciated, rotating the locking knobs 58 in a second direction loosens the first and second support arms 4, 6 with respect to the first and second side portions 24, 26, thus enabling the U-shaped support assembly 8, removable light module 14 and adjustable collar 28 to be moved along the adjustment axis A-A.

As will be appreciated, the locking knobs 58 can be accessed from below the fixture 1 through the adjustable collar 28, thus allowing an installer to make adjustments to the position of the adjustable collar 28 and U-shaped adjustment assembly 8 after the assembly 1 has been installed in the ceiling.

As mentioned, a guide link 60 and guide slot 62 arrangement can be used to guide movement of the adjustment plates 56 with respect to the first and second support arms 4, 6. In the illustrated embodiment, each of the first and second side portions 24, 26 can be provided with a guide link 60 fixed thereto. The guide link 60 may extend through a guide slot 62 disposed in each of the first and second support arms 4, 6. In the illustrated embodiment, the guide slot 62 is oriented parallel to the adjustment axis A-A. The guide link 60 may extend through a guide link opening 72 in the associated adjustment plate 56. As arranged, when the U-shaped support assembly 8 moves along the adjustment axis A-A, the assembly is guided in its movement with respect to the first and second support arms 4, 6.

A second guide slot 66 may also be provided in each of the first and second support arms 4, 6, and a second guide link 64 may be coupled to each adjustment plate 56. In the illustrated embodiment, the second guide slot 66 is positioned at an offset distance from the guide slot 62. The second guide slot 66 may also be oriented parallel to the guide slot 62 so that when the U-shaped support assembly 8 moves along the adjustment axis A-A, the second guide link 64 is movable within the second guide slot 66. In this way, the second guide slot 66 and the second guide link 64 can prevent rotation and/or pivoting of the adjustment plates 56 with respect to the first and second support arms 4, 6 and the first side portions 24, 26 of the U-shaped support assembly 8.

One or both of the adjustment assemblies 10, 12 may further include a provisional engagement feature for temporarily maintaining the position of the U-shaped adjustment assembly 8 and the adjustable collar 28 with respect to the position of the first and second support arms 4, 6. The provisional engagement feature maintains the U-shaped adjustment assembly 8 and the adjustable collar 28 in a desired position against the weight of the removable light module 14. As will be appreciated, the weight of the heat sink 30 may be sufficient to cause the U-shaped adjustment assembly 8 to move downward with respect to the first and second support arms 4, 6 and the plaster frame 2. Such a tendency may make it more difficult for an installer to make fine adjustments to the adjustable lighting assembly 1 using a single hand before locking the assembly into a final configuration. Thus, the provisional engagement feature may make it easier for an installer to make adjustments to the position of the adjustable collar 28.

Figure 6:
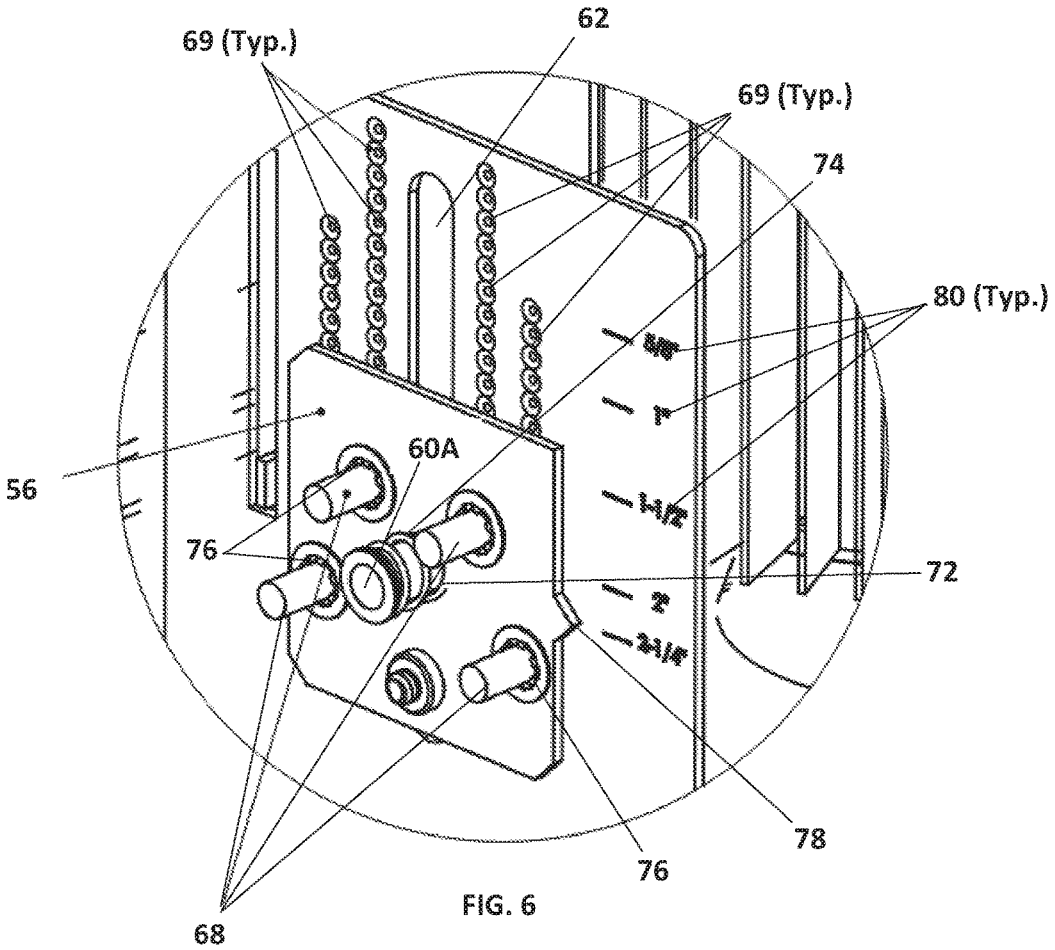
FIG. 6 is a detail view of an adjustment plate and guide arrangement of the adjustment assembly portion of FIG. 3.
Figure 7:
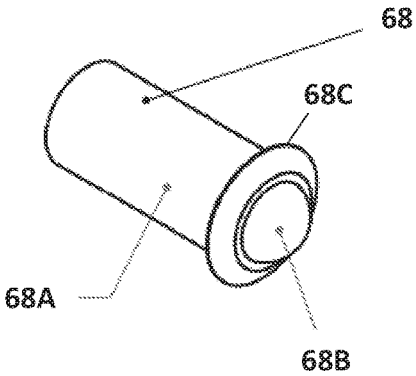
FIGS. 7 and 8 are isometric and side views of a ball plunger portion of the adjustment assembly portion of FIG. 3.
Figure 8:
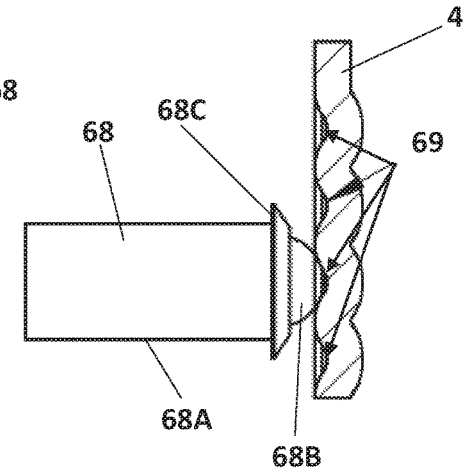

While any mechanism now known or hereafter developed may be used to provisionally maintain the position of the U-shaped adjustment assembly 8 and the adjustable collar 28 with respect to the position of the first and second support arms 4, 6, as shown in FIGS. 6-8, each of the adjustment assemblies 10, 12 may include a plurality of plungers 68 configured to engage with recesses or openings 69 disposed in the first and second support arms 4, 6 to form a detent mechanism. Although the description will proceed in relation to the adjustment assembly 10 associated with the first support arm 4, it will be appreciated that the description may apply equally to the adjustment assembly 12 associated with the second support arm 6.

In the illustrated embodiment, the plungers 68 comprise ball-plungers each having a cylindrical body portion 68A, a ball portion 68B and a spring (not shown). As will be appreciated, the spring may be disposed within the cylindrical body portion 68A and may bias the ball portion 68B away from the body portion 68A. The body portion 68A may include a raised shoulder portion 68C. As best shown in FIG. 6, the adjustment plate 56 may include a plurality of openings 76, each sized to receive the body portion 68A of one of the plungers 68 so that the ball portion 68B and the raised shoulder portion 68C are disposed between the adjustment plate 56 and the first support arm 4. In this position the ball portion 68B of each plunger 68 can engage a recess or opening 69 in the first support arm 4.

To maintain the ball portions 68B engaged with recesses or openings 69 in the first support arm 4, a biasing arrangement may be provided for the adjustment plate 56. As previously mentioned, each of the adjustment plates 56 may include a guide link 60. The guide link 60 may terminate in a head portion 60A. A spring 74 may be positioned about the guide link 60 so that the spring 74 is compressed between the head portion 60A of the guide link and a surface of the adjustment plate 56. As arranged, the spring 74 provides a tension force to the guide link 60, which clamps the adjustment plate 56 to the first support arm 4 and the first side portion 24 with a force sufficient to prevent free movement of the U-shaped support assembly 8 and the adjustable collar 28. The spring 74 may be sized to prevent such free movement of the U-shaped support assembly 8 and the adjustable collar 28 under the weight of the U-shaped support assembly 8 and a removable light module 14.

To facilitate stability, the plungers 68 may be disposed on both lateral sides of the guide slot 62. Thus, in the illustrated embodiment, a pair of plungers 68 are disposed on each lateral side of the guide slot 62. It will be appreciated that this is not critical and that fewer or greater numbers of plungers may be used.

In addition, to providing a desired fine degree of adjustability, each of the plungers 68 may have a corresponding group or array of recesses or openings 69 disposed on or in the first support arm 4. In the illustrated embodiment each of the four plungers 68 may have a corresponding vertically oriented group of recesses or openings 69, with each group aligned parallel to the guide slot 62 so that as the guide link 60 moves within the guide slot the ball portions 68B of the plungers 68 can move in and out of engagement with the associated recesses or openings 69.

To further facilitate adjustment of the U-shaped support assembly 8 (along with the removable light module 14 and the adjustable collar 28) to fit a particular ceiling thickness, one or both of the adjustment plates 56 may include a height indicator 78, and the first support and/or second support arms 4, 6 may include a plurality of extension indicators 80 arrayed parallel to the adjustment axis A-A. In the illustrated embodiment, the height indicator 78 includes an extension portion of the adjustment plate 56, though other indication features could be used, such as recesses, openings and the like. Each of the plurality of extension indicators 80 may signify a different predetermined distance between the bottom end 28B of the adjustable collar 28 and the bottom surface 3 of the plaster frame 2. Thus, when the U-shaped support assembly 8 is moved with respect to the plaster frame 2 so that the height indicator 78 aligns with a selected one of the plurality of extension indicators 80, the adjustable collar portion 28 can extend beyond a bottom surface 3 of the plaster frame 2 by a predetermined distance associated with the selected one of the plurality of extension indicators 80. In the illustrated embodiment, the extension indicators bear labels corresponding to exemplary ceiling thicknesses, such as ⅝", 1", 1½", 2" and 2¼". These thicknesses are non-limiting, and other thicknesses, or schemes, can be represented.

Figure 9A:
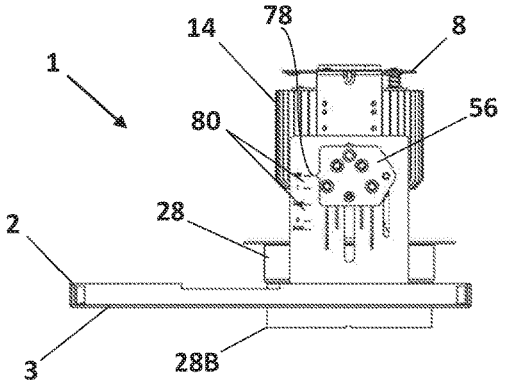
FIGS. 9A-B, 10A-B and 11A-B are side and cross-section views, respectively, of the adjustable lighting assembly of FIG. 1 in which the light module and adjustable collar are extended different amounts with respect to the plaster frame.
Figure 9B:
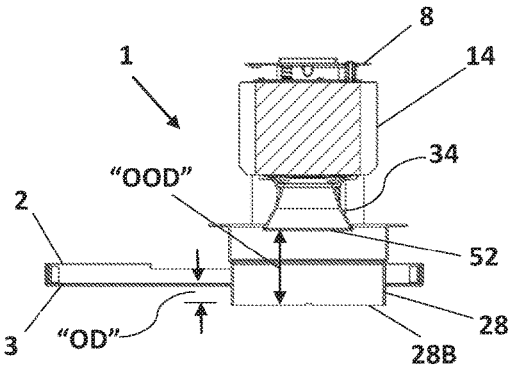
Figure 10A:
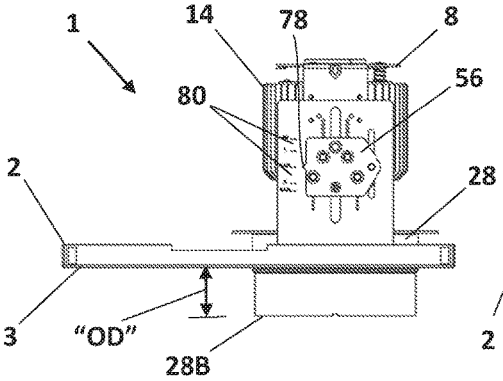
Figure 10B:
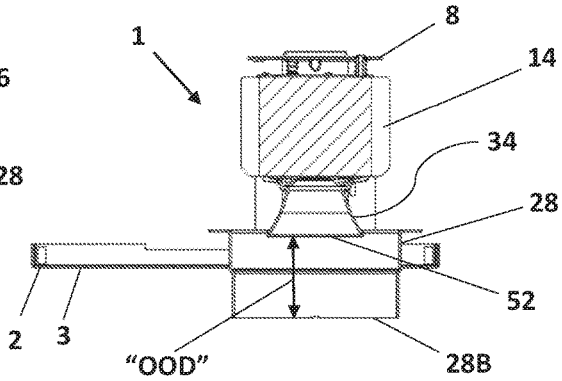
Figure 11A:
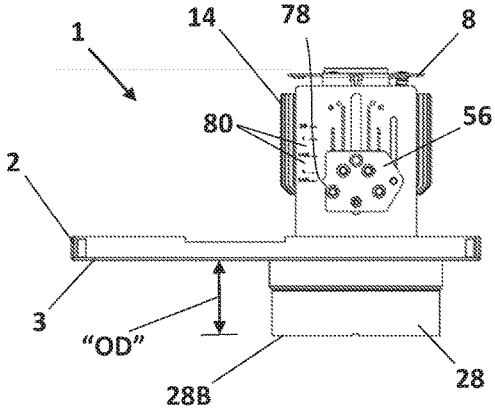
Figure 11B:
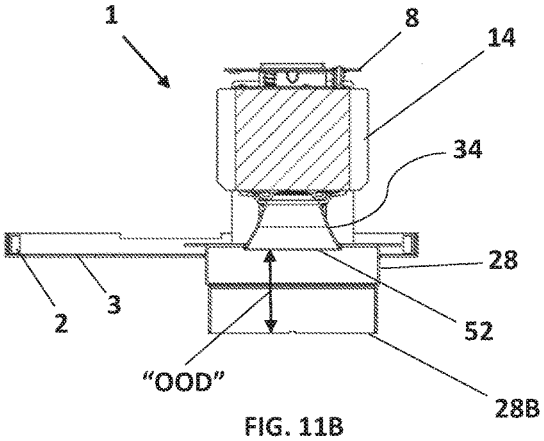

Referring now to FIGS. 9A-11B, the adjustable lighting assembly 1 is shown in a plurality of different adjustment positions associated with a plurality of different potential ceiling thicknesses. As can be seen, the different illustrated adjustment positions result in different offset distances "OD" between the bottom end 28B of the adjustable collar 28. For example, FIGS. 9A and 9B show the U-shaped support assembly 2 adjusted so that the height indicator 78 of the adjustment plate 56 is positioned adjacent to the uppermost extension indicator 80, which in the illustrated embodiment represents a ⅝" ceiling thickness. Thus, the offset distance "OD" between the bottom end 28B of the adjustable collar 28 and the bottom surface 3 of the plaster frame 2 in this position is ⅝-inch. FIGS. 10A and 10B show the U-shaped support assembly 2 adjusted so that the height indicator 78 of the adjustment plate 56 is positioned adjacent to the center extension indicator 80, which in the illustrated embodiment represents a 1½" ceiling thickness. Thus, the offset distance "OD" between the bottom end 28B of the adjustable collar 28 and the bottom surface 3 of the plaster frame 2 in this position is 1½-inches. FIGS. 11A and 11B show the U-shaped support assembly 2 adjusted so that the height indicator 78 of the adjustment plate 56 is positioned adjacent to the bottommost extension indicator 80, which in the illustrated embodiment represents a 2¼" ceiling thickness. Thus, the offset distance "OD" between the bottom end 28B of the adjustable collar 28 and the bottom surface 3 of the plaster frame 2 in this position is 2¼-inches.

As can be seen, the U-shaped support assembly 8, removable light module 14 and adjustable collar 28 move together as a single unit with respect to the plaster frame 2. Thus, the distance between the front edge 52 of the optic 34 to the bottom end 28B of the adjustable collar 28 (referred to as the optic offset distance "OOD") remains the same regardless of the adjusted position of the adjustable lighting assembly 1. Thus, the amount and quality of light emitted by the removable light module 14 to the room will be substantially the same regardless of the ceiling thickness and the adjusted position of the lighting assembly 1.

Figure 12A:
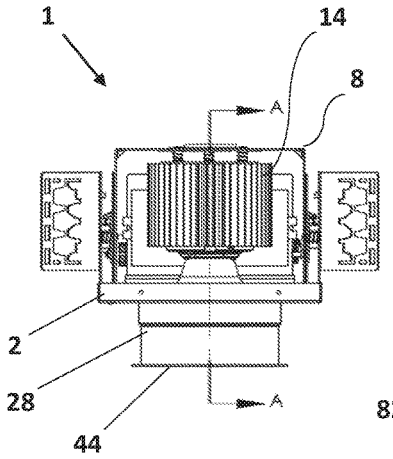
FIGS. 12A-B and 13A-B are end and cross-section views, respectively, of the adjustable lighting assembly of FIG. 1 in which the light module and adjustable collar are extended different amounts to accommodate specific exemplary ceiling thicknesses.
Figure 12B:
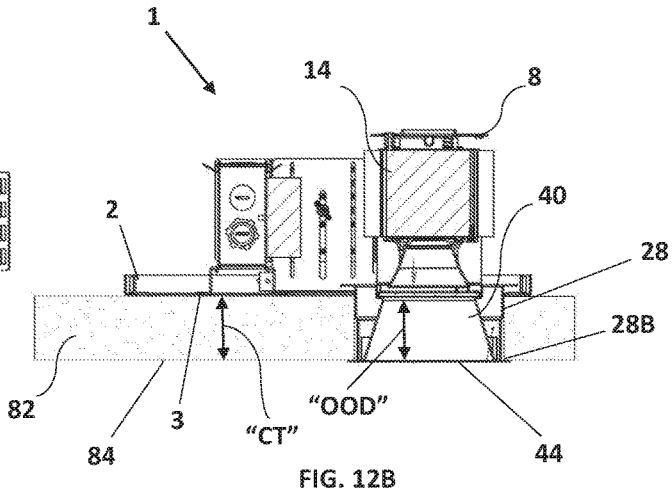
Figure 13A:
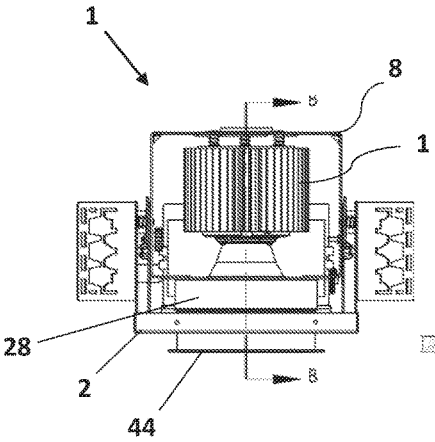
Figure 13B:
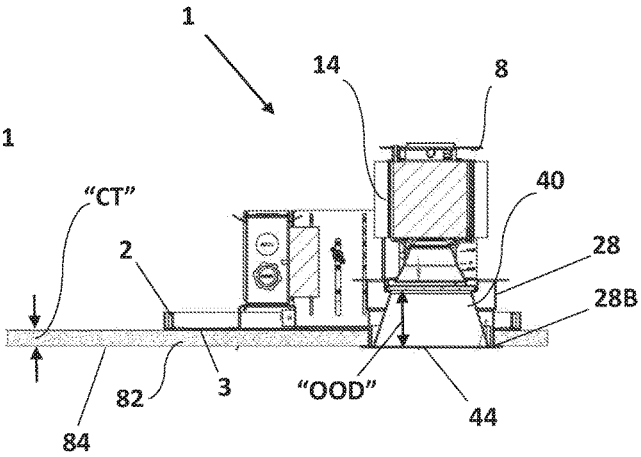

FIGS. 12A-13B show the adjustable lighting assembly 1 is shown in two exemplary adjustment positions associated with two exemplary ceiling thicknesses. For example, FIGS. 12A and 12B show the U-shaped support assembly 2, removable light module 14 and adjustable collar 28 installed in a ceiling 82 have a relatively large thickness "CT." As can be seen the trim portion 40 is installed, with the flange portion 44 flush with the bottom surface 84 of the ceiling 82. FIGS. 13A and 13B show the U-shaped support assembly 2, removable light module 14 and adjustable collar 28 installed in a ceiling 82 have a smaller thickness "CT" as compared to the ceiling of FIGS. 12A and 12B. Again, the trim portion 40 is installed, with the flange portion 44 flush with the bottom surface 84 of the ceiling 82. As can be seen, the optic offset distance "OOD" remains constant regardless of the thickness of the ceiling in which the adjustable lighting assembly 1 is installed.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilized for realizing the invention in diverse forms thereof.

What is claimed is:

1. A lighting device, comprising:

an adjustable collar for accommodating different ceiling thicknesses;

a plaster frame having an opening for receiving the adjustable collar;

at least one support arm coupled to the plaster frame adjacent the opening;

a support assembly; and an adjustment assembly for coupling the at least one support arm to the support assembly to enable the support assembly and the adjustable collar to be selectively movable;

wherein the adjustment assembly has a first configuration in which the adjustable collar is movable, and a second configuration in which the support assembly and the adjustable collar are fixed to the at least one support arm so that a bottom end of the adjustable collar extends beyond a bottom surface of the plaster frame.

2. The lighting device of claim 1, wherein the at least one support arm includes first and second support arms coupled to the plaster frame adjacent the opening, the first and second support arms extending from the plaster frame.

3. The lighting device of claim 2, wherein, in the first configuration, the adjustable collar is vertically movable towards and away from the plaster frame.

4. The lighting device of claim 2, wherein the support assembly includes first and second side portions and a top portion, the first and second side portions being coupled to the adjustable collar, the first and second side portions are positionable adjacent the first and second support arms, respectively, so that the adjustment assembly couples the first and second support arms to the first and second side portions of the support assembly.

5. The lighting device of claim 4, wherein the first and second support arms are coupled at respective first ends to the plaster frame adjacent the opening, and the first and second side portions of the support assembly are coupled at respective first ends to the adjustable collar.

6. The lighting device of claim 2, wherein the support assembly includes first and second side portions and a top portion so that the support assembly forms a generally U-shape support assembly.

7. The lighting device of claim 6, wherein, in the second configuration, the U-shaped support assembly and the adjustable collar are fixed to the first and second support arms so that a bottom end of the adjustable collar extends beyond a bottom surface of the plaster frame by a predetermined distance.

8. The lighting device of claim 6, wherein the U-shaped support assembly is fixed to the adjustable collar so that the U-shaped support assembly and the adjustable collar are movable together along an axis with respect to the plaster frame.

9. The lighting device of claim 6, wherein the adjustment assembly comprises an adjustment plate and a locking knob positioned on opposite sides of the first support arm and first side portion, wherein in the first configuration the locking knob and adjustment plate are positioned with respect to each other to enable movement of the first side portion with respect to the first support arm along the axis, and wherein in the second configuration the locking knob clamps the first support arm and the first side portion between the locking knob and the adjustment plate to lock the first support arm to the first side portion, thus preventing relative motion therebetween along the axis.

10. The lighting device of claim 9, further comprising a guide link for guiding movement of the U-shaped support assembly with respect to the plaster frame, wherein the guide link is coupled to the first side portion and is disposed through a guide slot in the first support arm, wherein the guide link is further disposed through an opening in the adjustment plate, and wherein the guide slot is oriented parallel to the axis such that the guide link is movable within the guide slot along the axis.

11. The lighting device of claim 10, wherein a first end of the guide link is axially fixed to the first side portion and is movable within the guide slot in the first support arm; and wherein a spring is disposed between the adjustment plate and a second end of the guide link to provide tension on the guide link, thereby clamping the adjustment plate to the first support arm and the first side portion with a force sufficient to prevent free movement of the U-shaped support assembly and the adjustable collar under a weight of the U-shaped support assembly and a removable light module attached thereto.

12. The lighting device of claim 10, further comprising a ball plunger coupled to the adjustment plate, the ball plunger comprising a ball element that is biased toward the first support arm, wherein the first support arm comprises a plurality of recesses, the plurality of recesses or holes positioned in a linear array oriented parallel to the axis, each of the plurality of recesses sized and shaped to receive at least a portion of the ball plunger to allow the adjustment plate to be fixed at a plurality of discrete positions with respect to the first support arm.

13. The lighting device of claim 12, wherein the ball plunger comprises a plurality of ball plungers coupled to the adjustment plate on opposing lateral sides of the guide link, and wherein the plurality of recesses or holes comprise a plurality of groups of recesses or holes, each group of recesses or holes is positioned on the first support arm to engage a respective one of said plurality of ball plungers.

14. The lighting device of claim 10, further comprising an additional guide slot in the first support arm and an additional guide link coupled to the adjustment plate, wherein the additional guide slot is positioned at an offset distance from the guide slot, wherein the additional guide slot is oriented parallel to the guide slot, and wherein when the U-shaped support assembly moves with respect to the plaster frame, the additional guide link is movable within the additional guide slot, and wherein the additional guide slot and additional guide link prevent rotation or pivoting of the adjustment plate with respect to the first support arm and the first side portion.

15. The lighting device of claim 9, wherein the adjustment plate has a height indicator and the first support arm includes a plurality of extension indicators arrayed parallel to the axis, wherein each of the plurality of extension indicators signifies a different predetermined distance between the bottom end of the adjustable collar and the bottom surface of the plaster frame, wherein when the U-shaped support assembly is moved with respect to the plaster frame so that the height indicator aligns with a selected one of the plurality of extension indicators, the adjustable collar portion extends beyond a bottom surface of the plaster frame by the predetermined distance associated with the selected one of the plurality of extension indicators.

16. The lighting device of claim 9, wherein the adjustment assembly comprises first and second adjustment plates and first and second locking knobs associated, respectively, with the first support arm and the first side portion, and the second support arm and the second side portion, and wherein in the first configuration the first and second locking knobs and the first and second adjustment plates enable movement of the first side portion with respect to the first support arm, and the second side portion with respect to the second support arm, along the axis, and wherein in the second configuration the first and second locking knobs preventing relative motion between the first side portion with respect to the first support arm, and the second side portion with respect to the second support arm along the axis.

17. The lighting device of claim 6, wherein the top portion includes surface features configured to couple the adjustment assembly to a removable light module such that the removable light module is movable along the axis simultaneously with the U-shaped support assembly and the adjustable collar, wherein the removable light module includes a heat sink, a plurality of LEDs and an optic.

18. A method for adjusting a lighting device for accommodating different ceiling thicknesses, comprising:

installing a lighting device in or on a ceiling structure, the lighting device including an adjustable collar, a plaster frame and a light module having a lighting element;

positioning a portion of the adjustable collar of the lighting device through a first opening in the ceiling structure and a second opening in the plaster frame; and adjusting the position of the adjustable collar with respect to the plaster frame and the ceiling structure so that a distal end surface of the adjustable collar is positioned adjacent to a distal portion of the second opening in the ceiling structure;

wherein, during the adjusting step, a front surface of the LED remains a fixed distance from the distal end surface of the adjustable collar.

19. The method of claim 18, wherein positioning a portion of the adjustable collar of the lighting device through a first opening in the ceiling structure comprises adjusting a position of a U-shaped support assembly with respect to the plaster frame, and wherein the U-shaped support assembly is fixedly coupled to the light module and the adjustable collar.

20. The method of claim 18, further comprising, after the adjusting step, securing the position of the adjustable collar with respect to the first opening in the ceiling structure and the second opening in the plaster frame.

21. The method of claim 20, wherein the securing step comprises turning a locking knob to draw first and second support arms coupled to the plaster frame into engagement with first and second side portions of a U-shaped support assembly such that friction between the first and second support arms and the first and second side portions, respectively, prevents movement of the U-shaped support assembly and the adjustable collar with respect to the plaster frame.

22. The method of claim 21, wherein the locking knob is accessible to a user from below the ceiling structure via a central opening in the adjustable collar.

23. The method of claim 18, further comprising provisionally retaining the adjustable collar and the light module in position with respect to the plaster frame and the ceiling structure via a plunger engaged with a U-shaped support assembly and first and second support arms, wherein the first and second support arms are coupled to the plaster frame, the light module is coupled to the U-shaped support assembly, and the U-shaped support assembly is moveably coupled to the first and second support arms.

24. The method of claim 18, further comprising, after the step of installing a lighting device in or on a ceiling structure, provisionally adjusting a position of the adjustable collar and the light module by aligning a height indicator of an adjustment plate with one of a plurality of extension indicators arrayed on a first support arm coupled to the plaster frame.

25. The method of claim 24, wherein each of the plurality of extension indicators signifies a different predetermined distance between the distal end surface of the adjustable collar and the bottom surface of the plaster frame.

26. An adjustment assembly for a lighting device, comprising:

an adjustable collar for accommodating different ceiling thicknesses;

a plaster frame having an opening for receiving the adjustable collar;

first and second support arms coupled to the plaster frame;

a support assembly having first and second side portions and a top portion, the first and second side portions coupled to the adjustable collar;

an adjustment assembly coupled between at least one of (i) the first support arm and the first side portion and (ii) the second support arms and the second side portion to enable the support assembly and the adjustable collar to be selectively movable along an axis perpendicular to the plaster frame; and an adjustment plate and a locking knob positioned on opposite sides of the first support arm and the first side portion;

wherein the adjustment assembly has a first configuration in which the adjustable collar portion is movable along the axis, and a second configuration in which the support assembly and the adjustable collar are fixed to the first and second support arms so that a bottom end of the adjustable collar extends beyond a bottom surface of the plaster frame; and wherein in the first configuration the locking knob and adjustment plate are positioned with respect to each other to enable movement of the first side portion with respect to the first support arm along the axis, and wherein in the second configuration the locking knob clamps the first support arm and the first side portion between the locking knob and the adjustment plate to lock the first support arm to the first side portion, thus preventing relative motion therebetween along the axis.

* * * * *